US006962315B2

(12) United States Patent
Lee et al.

(10) Patent No.: US 6,962,315 B2
(45) Date of Patent: Nov. 8, 2005

(54) MULTI-PURPOSE CLAMPING DEVICE

(76) Inventors: Ching-Chang Lee, 7F, No. 74, Sec. 2, Chien-Kuo N. Rd., Taipei City (TW); Ample Lee, 7F, No. 74, Sec. 2, Chien-Kuo N. Rd., Taipei City (TW)

( * ) Notice: Subject to any disclaimer, the term of this patent is extended or adjusted under 35 U.S.C. 154(b) by 0 days.

(21) Appl. No.: 10/861,345

(22) Filed: Jun. 7, 2004

(65) Prior Publication Data

US 2004/0238709 A1 Dec. 2, 2004

(30) Foreign Application Priority Data

Jun. 13, 2003 (TW) ..... 92210850 U

(51) Int. Cl.[7] ..... A47G 1/10
(52) U.S. Cl. ..... 248/316.1; 24/3.2; 211/85.1; 211/69.5; 248/206.5; 248/316.7; 248/902
(58) Field of Search ..... 248/316.1, 316.5, 248/316.6, 316.7, 206.5, 902; 211/85.1, 69.5; 40/658; 24/303, 10 R, 11 PP; 351/112, 155

(56) References Cited

U.S. PATENT DOCUMENTS 4,878,641 A * 11/1989 Vogt ..... 248/309.1
5,082,225 A * 1/1992 Nespoli ..... 248/231.81
5,184,794 A * 2/1993 Saito ..... 248/68.1
5,975,476 A * 11/1999 Mancinelli ..... 248/316.7
6,135,407 A * 10/2000 Havis et al. ..... 248/309.1
6,210,003 B1 * 4/2001 Chan ..... 351/112
6,367,126 B1 * 4/2002 Rivkin ..... 24/3.3
6,564,432 B1 * 5/2003 Kushner ..... 24/3.3
6,691,374 B2 * 2/2004 Coyne ..... 24/3.3
6,728,995 B2 * 5/2004 Ainley et al. ..... 24/3.3
2002/0046446 A1 * 4/2002 Kageyama ..... 24/10 R

* cited by examiner

*Primary Examiner*—Ramon O Ramirez
(74) *Attorney, Agent, or Firm*—Berenato, White & Stavish, LLC

(57) ABSTRACT

A clamping device includes elongated first and second butt housings that are connected pivotally to each other and that have free ends, which are locked relative to each other by a releasable locking unit. Two aligned first large notches in two side walls of the first butt housing and two aligned second large notches in two side walls of the second butt housing constitute a confining hole unit that is adapted to permit extension of an article. Elastic first and second pressing elements are disposed respectively within the first and second butt housings, and are adapted to clamp the article therebetween.

11 Claims, 7 Drawing Sheets

MULTI-PURPOSE CLAMPING DEVICE

CROSS-REFERENCE TO RELATED APPLICATION

This application claims priority of Taiwanese Application No. 092210850, filed on Jun. 13, 2003.

BACKGROUND OF THE INVENTION

1. Field of the Invention

This invention relates to a clamping device, and more particularly to a multi-purpose clamping device that can clamp a pair of eyeglasses, several sheets of paper, and a pen simultaneously.

2. Description of the Related Art

An eyeglass holder can be used to clamp a pair of eyeglasses, while a paper clip can be used to clamp a pen and several sheets of paper. However, in some cases, for example, a driver may need a pair of eyeglasses, several sheets of paper, and a pen in the driver compartment in a car. Therefore, a clamping device is required to have the functions of the eyeglass holder and a paper clip.

SUMMARY OF THE INVENTION

The object of this invention is to provide a multi-purpose clamping device that can clamp a pair of eyeglasses, several sheets of paper, and a pen. According to this invention, a clamping device includes elongated first and second butt housings that are connected pivotally to each other and that have free ends, which are locked relative to each other by a releasable locking unit. Two aligned first large notches in two side walls of the first butt housing and two aligned second large notches in two side walls of the second butt housing constitute a confining hole unit that is adapted to permit extension of the temples of a pair of eyeglasses therethrough Elastic first and second pressing elements are disposed respectively within the first and second butt housings, and are adapted to clamp the temples of the eyeglasses therebetween.

The side walls of the first butt housing further have two aligned semi-circular first small notches. The side walls of the second butt housing further have two aligned semi-circular second small notches. A pen can extend through the first and second small notches in the side walls of the first and second butt housing so as to be clamped between the first and second butt housings.

A paper clip unit is disposed on an outer surface of the second butt housing, and is adapted to clamp several sheets of paper.

Preferably, a clamping unit is disposed on an outer surface of the first butt housing, is adapted to clamp a laminated element, and may be replaced with a spring clip.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
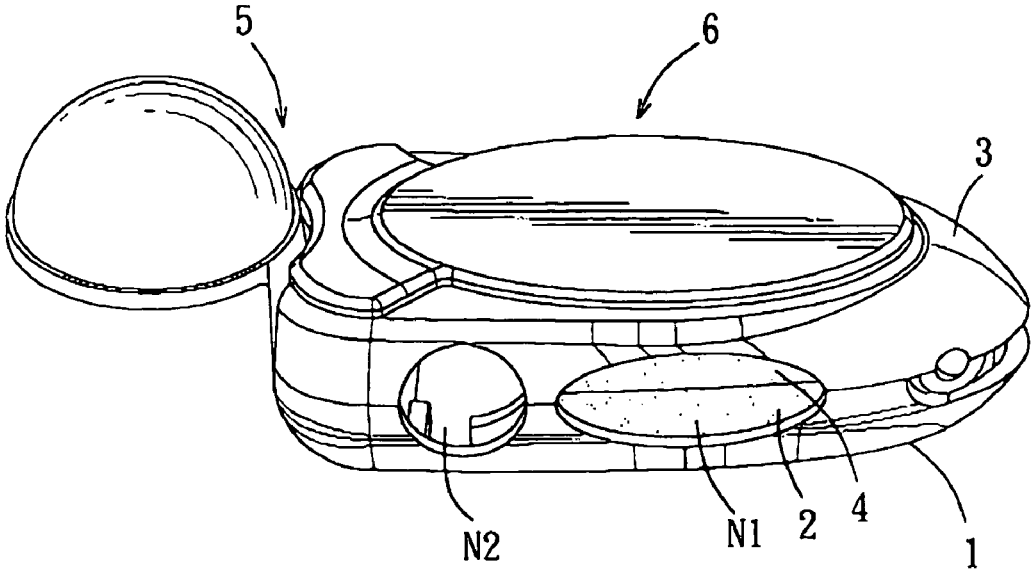
FIG. 1 is a fragmentary perspective view of the first preferred embodiment of a multi-purpose clamping device according to this invention, a clamping unit and a decoration element being removed.

Referring to FIGS. 1, 2, 3, 4, 5, 6, and 7, the preferred embodiment of a multi-purpose clamping device 1 according to this invention is shown to include an elongated first butt housing 1, an elastic first pressing element 2, an elongated second butt housing 3, an elastic second pressing element 4, a releasable locking unit 5, a paper clip unit 6, a clamping unit 7. The first and second butt housings 1, 3 are made of a plastic material, and constitute cooperatively a housing unit.

The first butt housing 1 has a pivot end (P1), a free end (F1) opposite to the pivot end (P1), a base wall (B1) (see FIG. 5), and two side walls (S1) extending respectively from two opposite sides of the base wall (B1) to define an interior space (C1) (see FIG. 4) among the base wall (B1) and the side walls (S1). Each of the side walls (S1) has an inner side (E1) that is formed with a semi-elliptical first large notch (N11) and a semi-circular first small notch (N12). Two stop elements (N13) (see FIGS. 3 and 4) are attached respectively and fixedly to inner surfaces of the side walls (S1), are disposed between the first large notches (N11) and the first small notches (N12), are adjacent to the first large notches (N11), and extend into the second butt housing 3.

The first pressing element 2 is made of sponge material, is attached fixedly to the base wall (B1) of the first butt housing 1, and is disposed within the interior chamber (C1) of the first butt housing 1 between the first large notches (N11) in the side walls (S1).

The second butt housing 3 has a pivot end (P3) connected pivotally to the pivot end (P1) of the first butting housing 1, a free end (F3), a base wall (B3) (see FIG. 6), and two side walls (53) extending respectively from two opposite sides of the base wall (B3) to define an interior space (C3) (see FIG. 7) among the base wall (B3) and the side walls (S3). Each of the side walls (S3) has an inner side (E3) that abuts against the inner side (E1) of the corresponding side wall (SI) of the first butt housing 1 and that is formed with a semi-elliptical second large notch (N21) and a semi-circular second small notch (N22), which are aligned respectively with the first large notch (N11) and the first small notch (N12) in the corresponding side wall (S1) of the first butt housing 1. The first and second large notches (N11, N21) in the first and second butt housings 1, 3 constitute cooperatively an elliptical confining space unit (N1) (see FIG. 2). The first and second small notches (N12, N22) in the first and second butt housings 1, 3 constitute cooperatively two circular holes (N2) (see FIG. 2) that are formed respectively in two opposite sides of the housing unit.

The second pressing element 4 is made of sponge material, is attached fixedly to the base wall (B3) of the second butt housing 3, and is disposed within the interior space (C3) in the second butt housing 3 between the second large notches (N21) in the side walls (S3).

Figure 13:
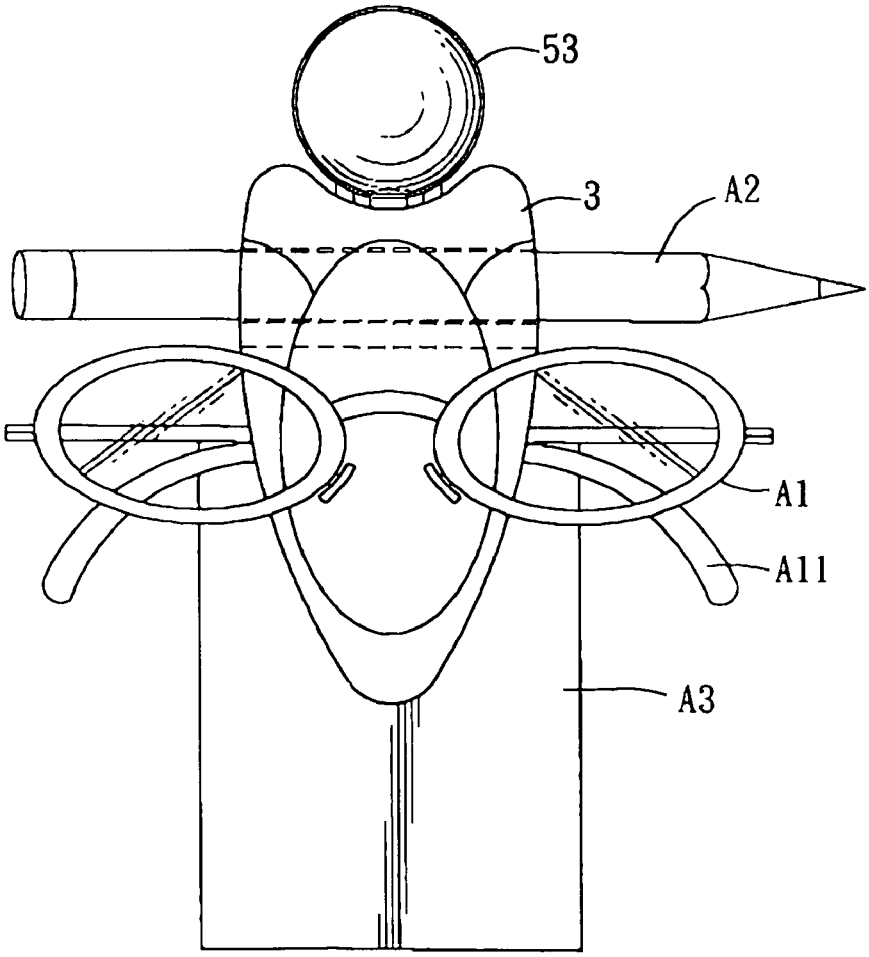
FIG. 13 is a fragmentary schematic view of the first preferred embodiment, illustrating how a pair of eyeglasses, a paper sheet, and a pencil are clamped.

As such, the temples (A11) (see FIGS. 2 and 13) of a pair of eyeglasses (A1) (see FIGS. 2 and 13) or the like can be inserted between the first and second bust housings 1, 3. The temples (A11) of the eyeglasses (A1) extend through the confining space unit (N1), and are clamped between the first and second butt housings 1, 3.

Figure 2:
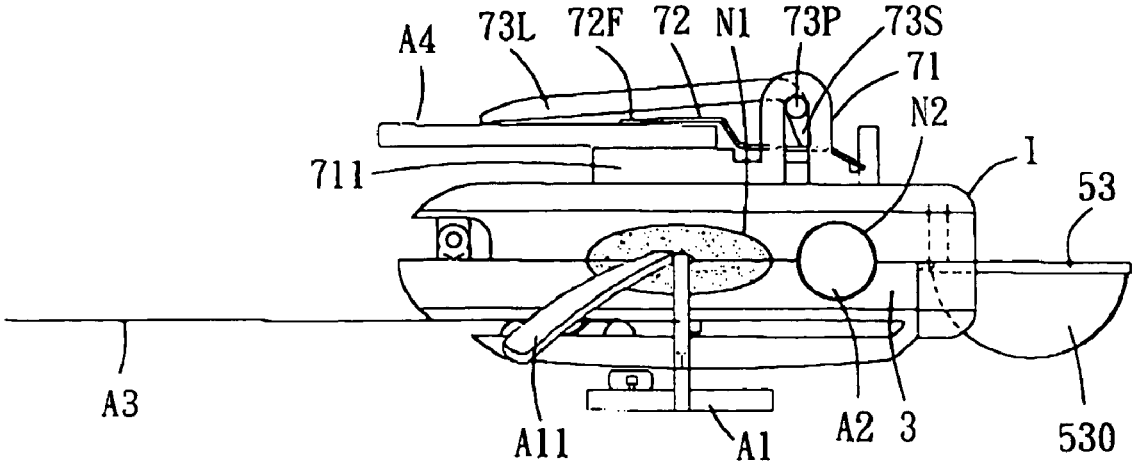
FIG. 2 is side view of the first preferred embodiment, illustrating how first and second butt housings are locked relative to each other.
Figure 3:
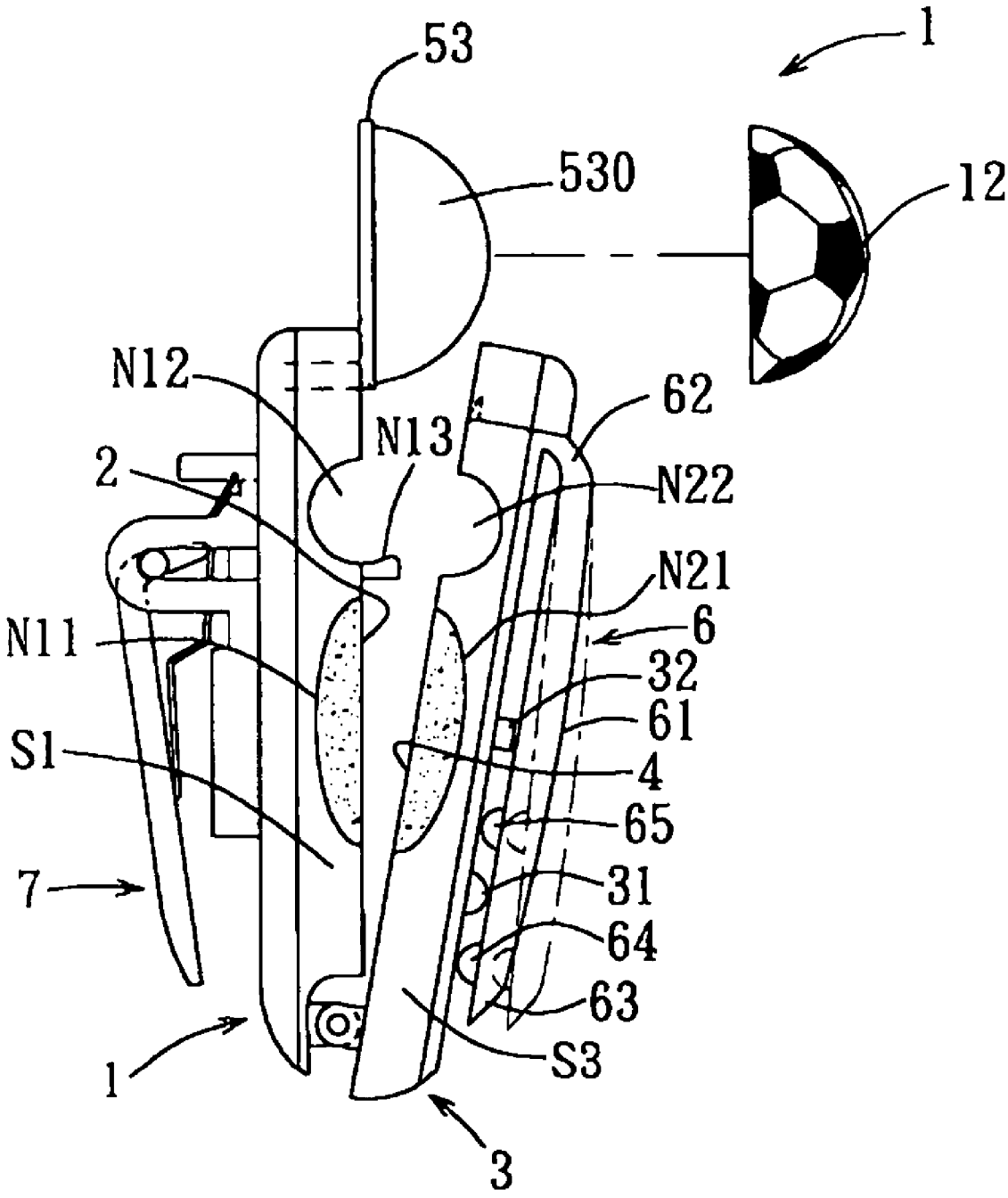
FIG. 3 is a side view of the first preferred embodiment, illustrating how the first and second butt housings are unlocked from each other.
Figure 4:
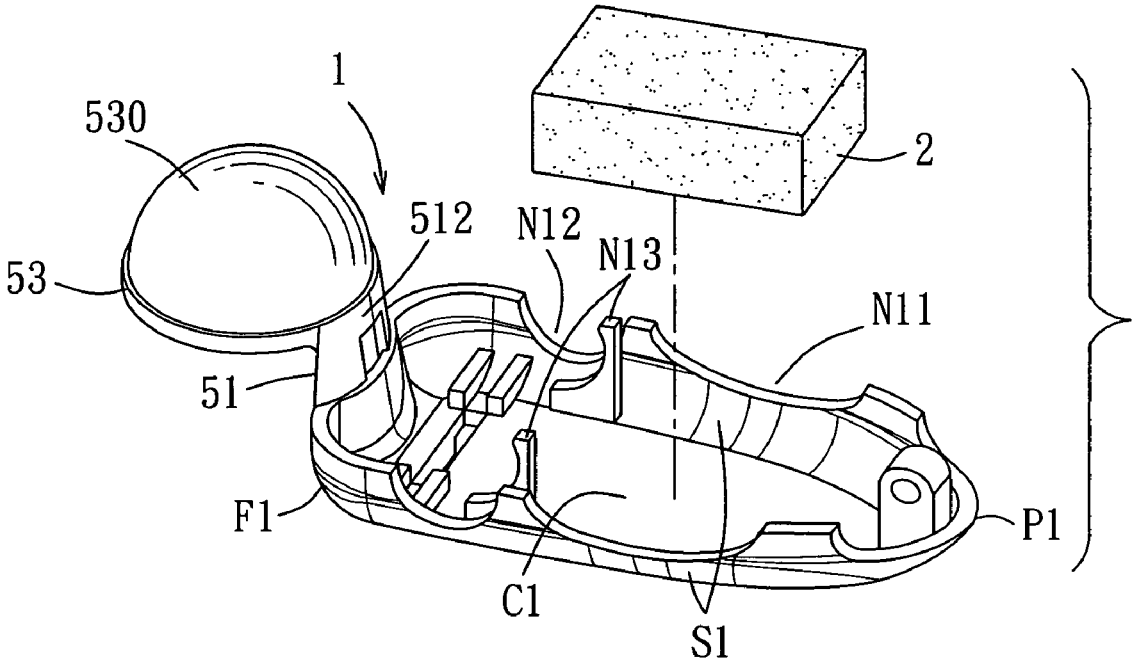
FIG. 4 is an exploded perspective view of the first butt housing and a first pressing element of the first preferred embodiment.
Figure 5:
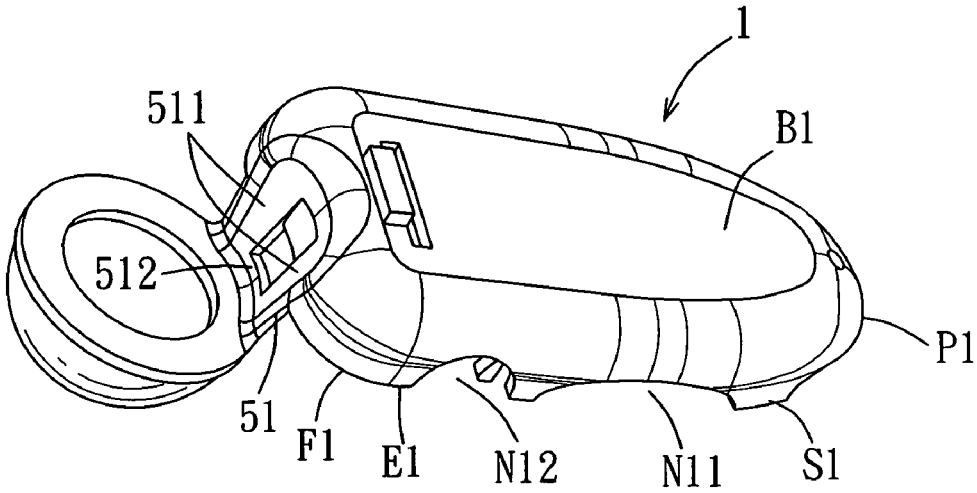
FIG. 5 is a perspective view of the first butt housing of the first preferred embodiment.

In addition, a pen (A2) (see FIGS. 2 and 13) or the like can also be inserted between the first and second butt housings 1, 3. The pen (A2) (see FIGS. 2 and 13) extends through the circular holes (N2), and is clamped between the first and second butt housings 1, 3. Of course, two additional pressing elements (not shown) may be attached respectively to the first and second butt housings 1, 3 for clamping the pen (A2) (see FIGS. 2 and 13) therebetween. When the first and second butt housings 1, 3 are turned away from each other such that the free ends (F1, F3) of the first and second butt housings 1, 3 are spaced apart from each other by a small distance, as shown in FIG. 3, the stop elements (N13) can prevent the pen (A2) from falling downwardly toward the pivot ends (P1, P3) of the first and second butt housings 1, 3.

Figure 6:
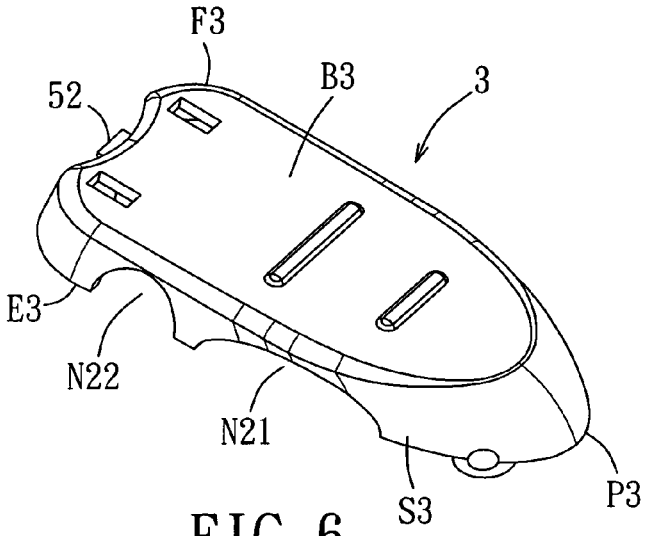
FIG. 6 is a perspective view of the second butt housing of the first preferred embodiment.
Figure 7:
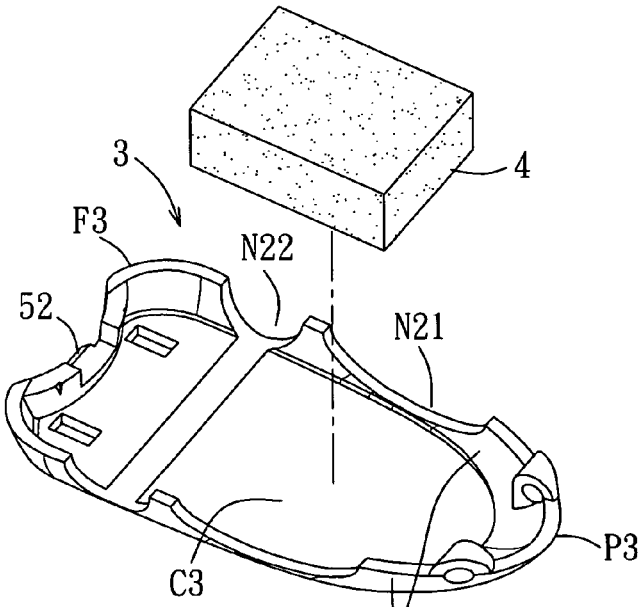
FIG. 7 is an exploded perspective view of a second pressing element and the second butt housing of the first preferred embodiment.
Figure 9:
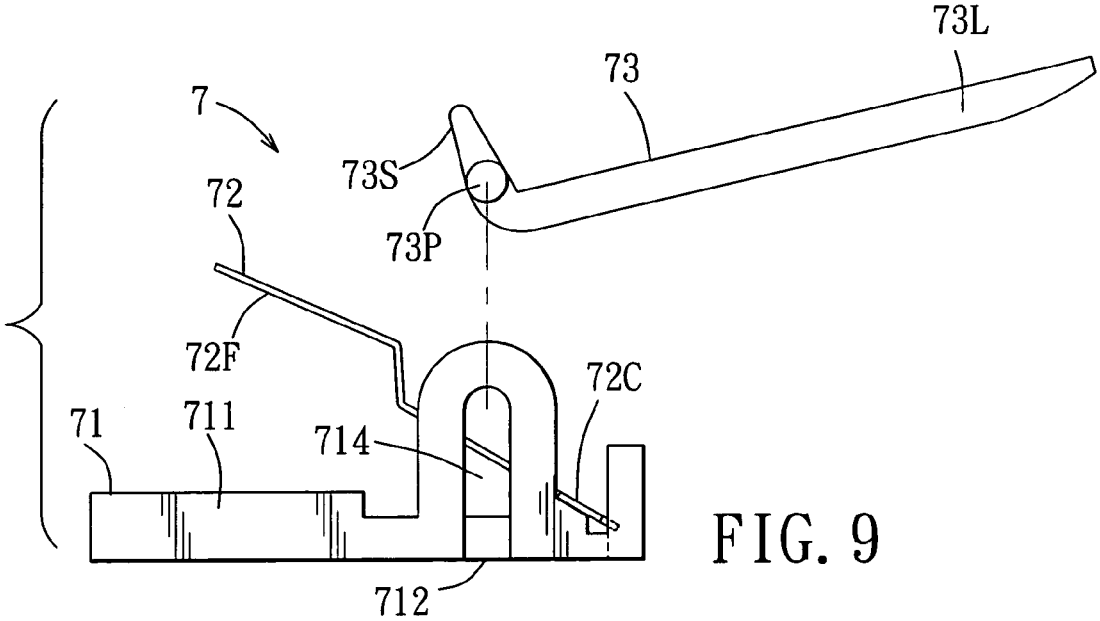
FIG. 9 is a partly exploded side view of the clamping unit of the first preferred embodiment.
Figure 10:
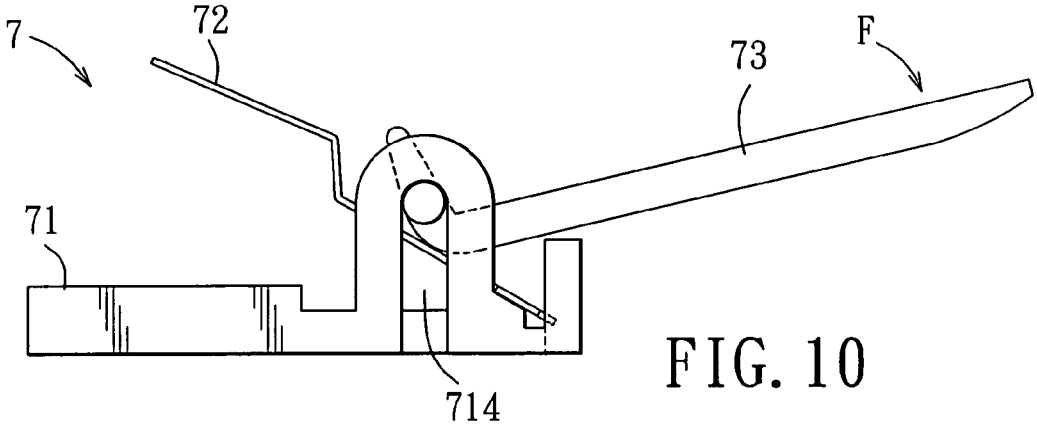
FIG. 10 is a side view of the clamping unit of the first preferred embodiment, illustrating how a U-shaped rotating plate is disposed at a release position.
Figure 11:
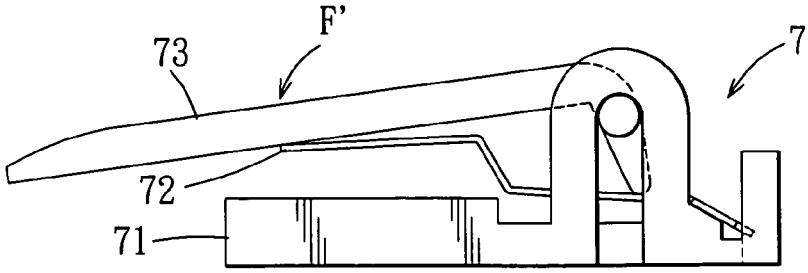
FIG. 11 is a side view of the clamping unit of the first preferred embodiment, illustrating how the L-shaped rotating plate is disposed at a clamping position.

The locking unit 5 interconnects the free ends (F1, F3) of the first and second butt housings 1, 3 so as to lock the first and second butt housings 1, 3 against each other, and includes a U-shaped locking plate 51 (see FIG. 4) and a retaining tongue 52 (see FIGS. 6 and 7). The locking plate 51 has two elongated parallel connecting plate portions 511 extending integrally and perpendicularly from an inner surface of the base wall (B1) of the first butt housing 1, and a retaining plate portion 512 having two ends that are formed respectively and integrally with spaced-apart outer ends of the connecting plate portions 511. The retaining tongue 52 extends integrally from the free end (F3) of the second butt housing 3 in a longitudinal direction of the second butt housing 3 and between the connecting plate portions 511 of the U-shaped locking plate 51, and abuts against the retaining plate portion S13 of the U-shaped locking plate 51 so as to prevent removal of the U-shaped locking plate 51 from the retaining tongue 52.

The U-shaped locking plate 51 is formed with an integrally actuator element 53 extending from the retaining plate portion 512 in a direction away from the pivot ends (P1, P3) of the first and second butt housings 1, 3. The actuator element 53 can be pressed from the position shown by the solid lines in FIG. 12 to the position shown by the phantom lines in FIG. 12 such that the connecting plate portions 511 flex so as to unlock the first and second butt housings 1, 3 from each other. This allows for removal of the free ends (F1, F3) of the first and second butt housings 1, 3 from each other.

The actuator element 53 has a hollow semi-spherical portion 530. The first butt housing 1 further includes a hollow semi-spherical decoration element 12 (see FIGS. 3 and 13) that has a football-simulating contour and that is sleeved on the semi-spherical portion 530 of the actuator element 53 in a tight fitting manner. The decoration element 12 may have other similar contours. For example, the contour of the element 12 can simulate a basketball, a tennis ball, a baseball, or a golf ball.

Referring to FIGS. 3 and 6, the paper clip unit 6 is formed on an outer surface of the base wall (B3) of the second butt housing 3, and includes an elongated flexible plate 61. The flexible plate 6 is generally parallel to and is adjacent to the outer surface of the base wall (B3), and has a connecting end 62 that is attached fixedly to the base wall (B3), and a free end 63 that is formed with an integral first portion 64 and an integral second projection 65. The second projection 65 is spaced apart from the first projection 64, and is disposed between the connecting end 62 of the flexible plate 61 and the first projection 64. A paper sheet (A3) (see FIGS. 2 and 13) can be inserted between the flexible plate 61 and the base wall (B3) of the second butt housing 3. In this case, the first and second projections 64, 65 will press the paper sheet (A3) (see FIGS. 2 and 13) against the outer surface of the base wall (B3). The outer surface of the base wall (B3) of the second butt housing 3 is formed with an integral third protection 31 disposed between the first and second projections 64, 65, and a fourth projection 32 disposed between the second projection 65 and the connecting end 62 of the flexible plate 61. The third and fourth projections 31, 32 press the paper sheet (A3) (see FIGS. 2 and 13) against the flexible plate 61.

Figure 8:
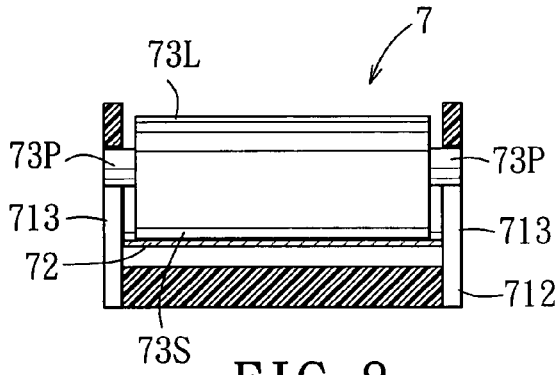
FIG. 8 is a sectional view of the clamping unit of the first preferred embodiment.
Figure 12:
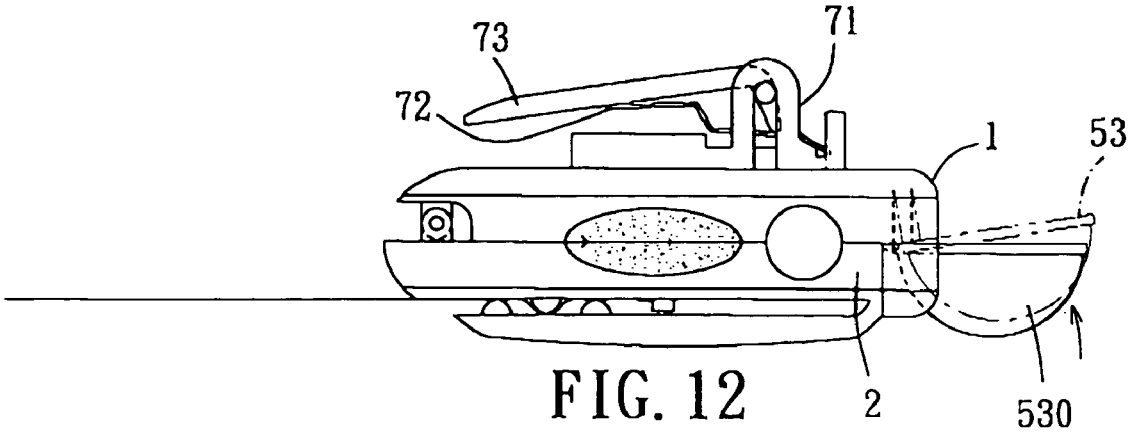
FIG. 12 is a side view of the first preferred embodiment, illustrating how an actuator element is pressed in order to unlock the first and second butt housings from each other.
Figure 14:
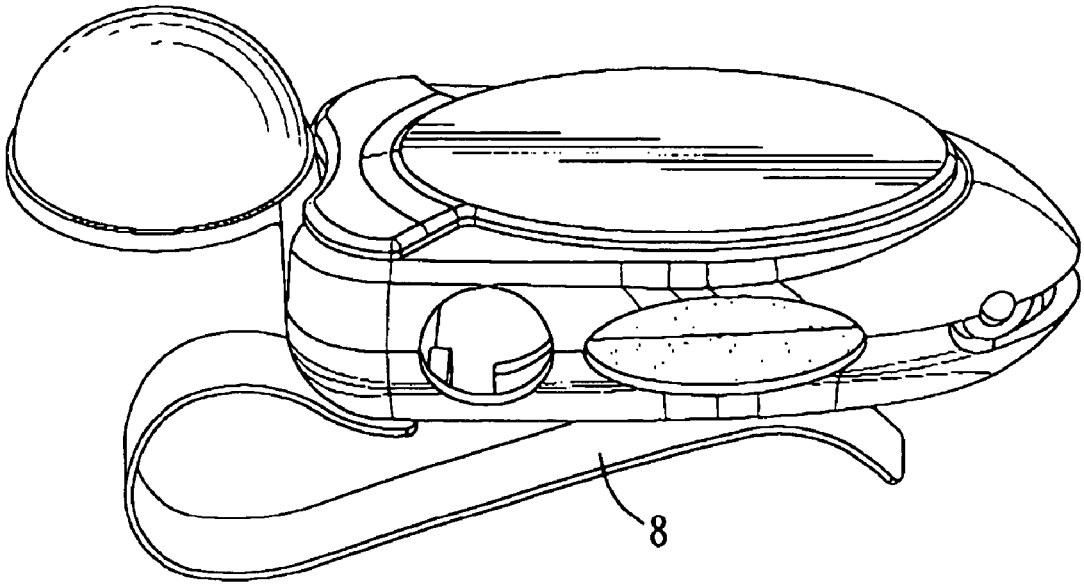
FIG. 14 is a fragmentary perspective view of the second preferred embodiment of a multi-purpose clamping device according to this invention.
Figure 15:
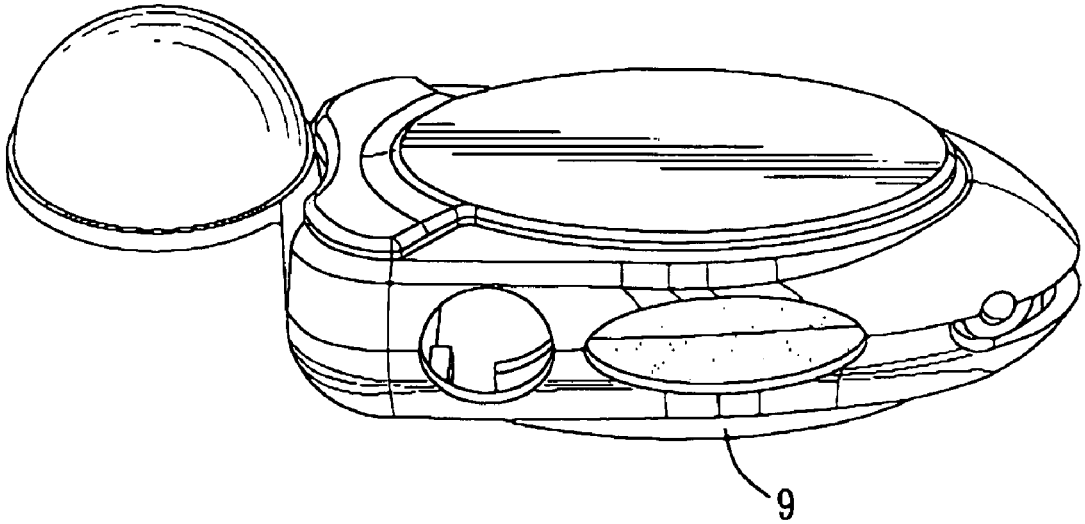
FIG. 15 is a fragmentary perspective view of the third preferred embodiment of a multi-purpose clamping device according to this invention.

Referring to FIGS. 5, 8, 9, 10, 11, and 12, the clamping unit 7 includes a mounting seat 71, an elongated zigzag reed spring 72, and an L-shaped rotating plate 73 The mounting seat 71 is disposed fixedly on an outer surface of the base wall (B1) of the first butt housing 1, and has a clamping portion 711 and a U-shaped bracket portion 712. The U-shaped bracket portion 712 has two aligned side plate portions 713 (see FIG. 8), each of which is formed with a slide slot extending along a direction generally perpendicular to the outer surface of the base wall (B1) of the first butt housing 1. The reed spring 72 has a connecting end (72C) fastened to the mounting seat 71. The L-shaped rotating plate 73 (see FIGS. 2 and 9) includes a long plate portion (73L), a short plate portion (73S), and two pivot pins (73P). An inner end of the long plate portion (73L) is disposed between the side plate portions (713) of the U-shaped bracket portion 712 of the mounting seat 71, as shown in FIG. 8. An outer end of the long plate portion (73L) abuts against the free end (72F) of the reed spring 72, and is adjacent to the clamping portion 711 of the mounting seat 71. The short plate portion (73S) extends perpendicularly to the long plate portion (73L), and has an inner end formed integrally with the inner end of the long plate portion (73L) and contacting the reed spring 72, as shown in FIGS. 2 and 12. The pivot pins (73P) extend outwardly from the inner end of the short plate portion (73S) away from each other, and are received respectively and slidably within the slide slots 714 in the mounting seat 71. The outer end of the short plate portion (73S) contacts the reed spring 72 at a location shown in FIGS. 11 and 12 such that the reed spring 72 biases the long plate portion 73 (L) to rotate toward the clamping portion 711 of the mounting seat 71. Therefore, the outer end of the long plate portion (73L) of the rotating plate 73 and the free end (72F) of the reed spring 72 can press a laminated element or plate (A4) (see FIG. 2) against the clamping portion 711 of the mounting seat 71. As such, the rotating plate 73 is rotatable between a release position shown in FIG. 10 and a clamping position shown in FIG. 11. The clamping unit 7 can be replaced with a spring clip 8 (see FIG. 14) or a magnet 9 (see FIG. 15), which is attached fixedly to the outer surface of the base wall (B1) of the first butt housing 1. In use, the spring clip 8 can be attached to a waist belt, a pocket, a sun shield provided in a driver compartment of a car, and so on.

With this invention thus explained, it is apparent that numerous modifications and variations can be made without departing from the scope and spirit of this invention. It is therefore intended that this invention be limited only as indicated by the appended claims.

We claim:

1. A clamping device comprising:

an elongated first butt housing having a pivot end, a free end opposite to said pivot end, a base wall, and two side walls extending respectively from two opposite sides of said base wall to define an interior space among said base and said side walls of said first butt housing, each of said side walls of said first butt housing having an inner side that is formed with a first large notch;

an elastic first pressing element attached fixedly to said base wall of said first butt housing and disposed within said interior space in said first butt housing between said first large notches in said side walls of said first butt housing;

an elongated second butt housing having a pivot end connected pivotally to said pivot end of said first butt housing, a free end, a base wall, and two side walls extending respectively from two opposite sides of said base wall of said second butt housing to define an interior space among said base wall and said side walls of said second butt housing, each of said side walls of said second butt housing having an inner side that abuts against said inner side of a corresponding one of said side walls of said first butt housing and that is formed with a second large notch which is aligned with said first large notch in said first butt housing, said first large notches in said side walls of said first butt housing and said second large notches in said side walls of said second butt housing constituting cooperatively a confining space unit between said first and second butt housings, said confining space unit being adapted to allow for extension of an article therethrough;

an elastic second pressing element attached fixedly to said base wall of said second butt housing and disposed within said interior space in said second butt housing between said second large notches in said side walls of said second butt housing, said first and second pressing elements being adapted to clamp the article therebetween; and a releasable locking unit interconnecting said free ends of said first and second butt housings so as to lock the first and second butt housings against each other, said locking unit being operable to unlock said first and second butt housings from each other;

wherein said base wall of said second butt housing has an outer surface that is formed with a paper clip unit, said paper clip unit including an elongated flexible plate that is generally parallel to and that is adjacent to said outer surface of said base wall of said second butt housing and that has a connecting end attached fixedly to said outer surface of said base wall of said second butt housing, and a free end which is adapted to press a paper sheet against said outer surface of said base wall of said second butt housing; and wherein said free end of said flexible plate is formed with a first projection and a second projection that is spaced apart from said first projection and that is disposed between said connecting end of said flexible plate and said first projection, said first and second projection pressing against said outer surface of said base wall of said second butt housing and adapted to press the paper sheet against said outer surface of said base wall of said second butt housing.

2. The clamping device as claimed in claim 1, wherein said outer surface of said base wall of said second butt housing is formed with a third projection disposed between said first and second projections, and a fourth projection disposed between said second projection and said connecting end of said flexible plate, said third and fourth projections being adapted to press the paper sheet against said flexible plate.

3. A clamping device comprising:

an elongated first butt housing having a pivot end, a free end opposite to said pivot end, a base wall, and two side walls extending respectively from two opposite sides of said base wall to define an interior space among said base and said side walls of said first butt housing, each of said side walls of said first butt housing having an inner side that is formed with a first large notch;

an elastic first pressing element attached fixedly to said base wall of said first butt housing and disposed within said interior space in said first butt housing between said first large notches in said side walls of said first butt housing;

an elongated second butt housing having a pivot end connected pivotally to said pivot end of said first butt housing, a free end, a base wall, and two side walls extending respectively from two opposite sides of said base wall of said second butt housing to define an interior space among said base wall and said side walls of said second butt housing, each of said side walls of said second butt housing having an inner side that abuts against said inner side of a corresponding one of said side walls of said first butt housing and that is formed with a second large notch which is aligned with said first large notch in said first butt housing, said first large notches in said side walls of said first butt housing and said second large notches in said side walls of said second butt housing constituting cooperatively a confining space unit between said first and second butt housings, said confining space unit being adapted to allow for extension of an article therethrough;

an elastic second pressing element attached fixedly to said base wall of said second butt housing and disposed within said interior space in said second butt housing between said second large notches in said side walls of said second butt housing, said first and second pressing elements being adapted to clamp the article therebetween;

a releasable locking unit interconnecting said free ends of said first and second butt housings so as to lock the first and second butt housings against each other, said locking unit being operable to unlock said first and second butt housings from each other; and a clamping unit, which includes: a mounting seat disposed fixedly on an outer surface of said base wall of said first butt housing and having a clamping portion and a U-shaped bracket portion that has two aligned side plate portions, each of which is formed with a slide slot extending along a direction generally perpendicular to said outer surface of said base wall of said first butt housing;

an elongated zigzag reed spring having a connecting end fastened to said mounting seat, and a free end; and an L-shaped rotating plate including a long plate portion having an inner end disposed between said side plate portions of said U-shaped bracket portion of said mounting seat, and an outer end abutting said free end of said reed spring and adjacent to said clamping portion of said mounting seat, a short plate portion extending perpendicularly to said long plate portion and having an inner end formed integrally with said inner end of said long plate portion, and an outer end contacting said reed spring, and two pivot pins extending outwardly from said inner end of said short plate portion away from each other and received respectively and slidably within said slide slots in said mounting seat, said outer end of said short plate portion contacting said reed spring at a location such that said reed spring biases said long plate portion to rotate toward said clamping portion of said mounting seat, said outer end of said long plate portion of said L-shaped rotating plate and said free end of said reed spring being adapted to press a laminated element against said clamping portion of said mounting seat.

4. A clamping device comprising:

an elongated first butt housing having a pivot end, a free end opposite to said pivot end, a base wall, and two side walls extending respectively from two opposite sides of said base wall to define an interior space among said base and said side walls of said first butt housing, each of said side walls of said first butt housing having an inner side that is formed with a first large notch;

an elastic first pressing element attached fixedly to said base wall of said first butt housing and disposed within said interior space in said first butt housing between said first large notches in said side walls of said first butt housing;

an elongated second butt housing having a pivot end connected pivotally to said pivot end of said first butt housing, a free end, a base wall, and two side walls extending respectively from two opposite sides of said base wall of said second butt housing to define an interior space among said base wall and said side walls of said second butt housing, each of said side walls of said second butt housing having an inner side that abuts against said inner side of a corresponding one of said side walls of said first butt housing and that is formed with a second large notch which is aligned with said first large notch in said first butt housing, said first large notches in said side walls of said first butt housing and said second large notches in said side walls of said second butt housing constituting cooperatively a confining space unit between said first and second butt housings, said confining space unit being adapted to allow for extension of an article therethrough;

an elastic second pressing element attached fixedly to said base wall of said second butt housing and disposed within said interior space in said second butt housing between said second large notches in said side walls of said second butt housing, said first and second Pressing elements being adapted to clamp the article therebetween; and a releasable locking unit interconnecting said free ends of said first and second butt housings so as to lock the first and second butt housings against each other, said locking unit being operable to unlock said first and second butt housings from each other;

wherein said first and second butt housings constitute a housing unit, said inner side of each of said side walls of said first butt housing being further formed with a semi-circular first small notch, said inner side of each of said side walls of said second butt housing being further formed with a semi-circular second small notch that is aligned with a corresponding one of said first small notches in said first butt housing so as to constitute a circular hole in each of two opposite sides of said housing unit, whereby a pen can extend through said first and second small notches in said first and second butt housings so as to be clamped between said first and second butt housings.

5. The clamping device as claimed in claim 4, wherein said first butt housing further includes two stop elements that are attached respectively and fixedly to inner surfaces of said side walls of said first butt housing, that are disposed between said first large notches and said first small notches, that are adjacent to said first large notches, and that extend into said second butt housing.

6. The clamping device as claimed in claim 4, wherein said first and second pressing elements are made of sponge material.

7. The clamping device as claimed in claim 4, wherein said first and second butt housings are made of a plastic material, said free end of said first butt housing being formed with a U-shaped locking plate that has two elongated parallel connecting plate portions extending integrally and perpendicularly from an inner surface of said base wall of said first butt housing and having two outer ends that are spaced apart from each other, and a retaining plate portion having two ends that are formed respectively and integrally with said outer ends of said connecting plate portions, said free end of said second butt housing being formed with a retaining tongue that extends integrally therefrom in a longitudinal direction of said second butt housing and between said connecting plate portions of said U-shaped locking plate and that abuts against said retaining plate portion so as to prevent removal of said U-shaped locking plate of said first butt housing from said retaining tongue of said second butt housing, said U-shaped locking plate of said first butt housing and said retaining tongue of said second butt housing constituting cooperatively said releasable locking unit.

8. The clamping device as claimed in claim 7, wherein said U-shaped locking plate of said first butt housing is formed with an integral actuator element that extends integrally from said retaining plate portion of said U-shaped locking plate in a direction away from said pivot ends of said first and second butt housings and that can be pressed such that said connecting plate portions of said U-shaped locking plate flex, thereby permitting removal of said U-shaped locking plate of said first butt housing from said retaining tongue of said second butt housing.

9. The clamping device as claimed in claim 8, wherein said actuator element of said first butt housing has a hollow semi-spherical portion, said first butt housing further including a hollow semi-spherical decoration element that is sleeved on said semi-spherical portion of said actuator element in a tight fitting manner.

10. The clamping device as claimed in claim 4, further comprising a spring clip attached fixedly to an outer surface of said base wall of said first butt housing.

11. The clamping device as claimed in claim 4, further comprising a magnet attached fixedly to an outer surface of said base wall of said first butt housing.

* * * * *